US010323520B2

(12) United States Patent
Perry, II et al.

(10) Patent No.: US 10,323,520 B2
(45) Date of Patent: Jun. 18, 2019

(54) PLATFORM COOLING ARRANGEMENT IN A TURBINE ROTOR BLADE

(71) Applicant: GENERAL ELECTRIC COMPANY, Schenectady, NY (US)

(72) Inventors: Jacob Charles Perry, II, Greenville, SC (US); Sean Gunning, Greenville, SC (US); Tyler Barry, Houston, TX (US); Jose Troitino Lopez, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 232 days.

(21) Appl. No.: 15/621,473

(22) Filed: Jun. 13, 2017

(65) Prior Publication Data

US 2018/0355726 A1 Dec. 13, 2018

(51) Int. Cl.

| | |
|---|---|
| ***F01D 5/08*** | (2006.01) |
| ***F01D 25/12*** | (2006.01) |
| ***F01D 5/18*** | (2006.01) |
| *F01D 25/08* | (2006.01) |

(52) U.S. Cl.

CPC ..... *F01D 5/085* (2013.01); *F01D 5/187* (2013.01); *F01D 25/12* (2013.01); *F01D 5/08* (2013.01); *F01D 25/08* (2013.01); *F05D 2240/80* (2013.01); *F05D 2240/81* (2013.01); *F05D 2260/201* (2013.01); *F05D 2260/204* (2013.01)

(58) Field of Classification Search

CPC ..... F01D 5/085; F01D 5/187; F01D 5/188; F01D 25/12; F01D 5/08; F01D 25/08; F05D 2260/204; F05D 2260/201; F05D 2240/81; F05D 2240/80

See application file for complete search history.

(56) References Cited

U.S. PATENT DOCUMENTS

| | | | | | |
|---|---|---|---|---|---|
| 4,672,727 | A * | 6/1987 | Field | B23P 15/02 | 29/527.2 |
| 4,712,979 | A * | 12/1987 | Finger | F01D 5/081 | 415/115 |
| 5,513,955 | A * | 5/1996 | Barcza | F01D 5/22 | 416/193 A |
| 6,120,249 | A * | 9/2000 | Hultgren | F01D 5/187 | 416/193 A |

(Continued)

*Primary Examiner* — Hung Q Nguyen

(74) *Attorney, Agent, or Firm* — McNees Wallace & Nurick LLC

(57) ABSTRACT

A platform cooling arrangement in a turbine rotor blade having a platform at an interface between an airfoil and a root, wherein the rotor blade includes an interior cooling passage formed therein that extends from a connection with a coolant source at the root to at least the approximate radial height of the platform. The platform cooling arrangement includes a platform slot formed through at least one of a pressure side slashface and a suction side slashface, the platform slot being in fluid communication with a high-pressure coolant region of the turbine rotor blade. An insert inserted in the platform slot, the insert having a blind channel extending inside the insert. The insert aligns with the platform slot to fluidly connect the channel to the high-pressure coolant region. At least one passage is in fluid communication with the channel and an exterior region of the turbine rotor blade.

18 Claims, 11 Drawing Sheets

(56) References Cited

U.S. PATENT DOCUMENTS

| | | | | |
|---|---|---|---|---|
| 8,021,118 | B2 * | 9/2011 | Bergander | F01D 5/18 416/193 A |
| 8,734,111 | B2 * | 5/2014 | Lomas | F01D 5/187 416/193 A |
| 8,777,568 | B2 * | 7/2014 | Ellis | F01D 5/087 29/402.01 |
| 8,840,370 | B2 * | 9/2014 | Walunj | F01D 5/186 416/193 A |
| 9,249,674 | B2 * | 2/2016 | Ellis | F01D 5/187 |
| 10,001,017 | B2 * | 6/2018 | Haggmark | F01D 11/006 |
| 10,030,523 | B2 * | 7/2018 | Quach | F01D 5/187 |
| 10,215,051 | B2 * | 2/2019 | Thomen | F04D 29/542 |
| 2006/0024151 | A1 * | 2/2006 | Keith | F01D 5/081 415/97 |
| 2012/0082549 | A1 | 4/2012 | Ellis et al. | |
| 2012/0082550 | A1 | 4/2012 | Harris, Jr. et al. | |
| 2012/0082565 | A1 | 4/2012 | Ellis et al. | |

* cited by examiner

PLATFORM COOLING ARRANGEMENT IN A TURBINE ROTOR BLADE

FIELD OF THE DISCLOSURE

The present disclosure is directed to a cooling arrangement and method of cooling a turbine rotor blade. More particularly, the present disclosure is directed to a cooling arrangement and method of cooling a platform region of a turbine rotor blade.

BACKGROUND OF THE DISCLOSURE

Certain components, such as gas turbine components operate at high temperatures and under harsh conditions. Cooling passages may be formed in gas turbine components to help circulate coolant for extending the service life of these components. However, incorporating cooling passages, such as by casting, is expensive.

BRIEF DESCRIPTION OF THE DISCLOSURE

In an exemplary embodiment, a platform cooling arrangement in a turbine rotor blade has a platform at an interface between an airfoil and a root. The rotor blade includes an interior cooling passage formed therein that extends from a connection with a coolant source at the root to at least the approximate radial height of the platform. In operation, the interior cooling passage includes a high-pressure coolant region in fluid communication with a corresponding high-pressure coolant region of the platform, the high-pressure coolant region of the platform extending to a low-pressure coolant region of the platform at least one of a pressure side slashface and a suction side slashface. The platform cooling arrangement includes a platform slot formed through at least one of the pressure side slashface and the suction side slashface, the platform slot being in fluid communication with the high-pressure coolant region of the turbine rotor blade. The platform cooling arrangement further provides an insert inserted in the platform slot, the insert having a blind channel extending inside the insert from a predetermined location of the insert, the insert aligns with the platform slot to fluidly connect the channel to the high-pressure coolant region at the predetermined location. The platform cooling arrangement further provides at least one passage in fluid communication with the channel and an exterior region of the turbine rotor blade.

In another exemplary embodiment, a method of creating a platform cooling arrangement for a turbine rotor blade having a platform at an interface between an airfoil and a root. The rotor blade includes an interior cooling passage formed therein that extends from a connection with a coolant source at the root to at least the approximate radial height of the platform. In operation, the interior cooling passage includes a high-pressure coolant region in fluid communication with a corresponding high-pressure coolant region of the platform, the high-pressure coolant region of the platform extending to a low-pressure coolant region of the platform at least one of a pressure side slashface and a suction side slashface. The method includes the steps of forming a platform slot through at least one of the pressure side slashface and the suction side slashface, the platform slot being in fluid communication with the high-pressure coolant region of the turbine rotor blade. The method further includes forming an insert that includes a blind channel extending inside of the insert from a predetermined location of the insert. The method further includes installing the insert within the platform slot such that the insert aligns with the platform slot to fluidly connect the channel to the high-pressure region at the predetermined location. The method further includes forming at least one passage in fluid communication with the channel and an exterior surface of the turbine rotor blade.

Other features and advantages of the present disclosure will be apparent from the following more detailed description of the preferred embodiment, taken in conjunction with the accompanying drawings, which illustrate, by way of example, the principles of the disclosure.

BRIEF DESCRIPTION OF THE DRAWINGS

Wherever possible, the same reference numbers will be used throughout the drawings to represent the same parts.

DETAILED DESCRIPTION OF THE DISCLOSURE

Figure 1:
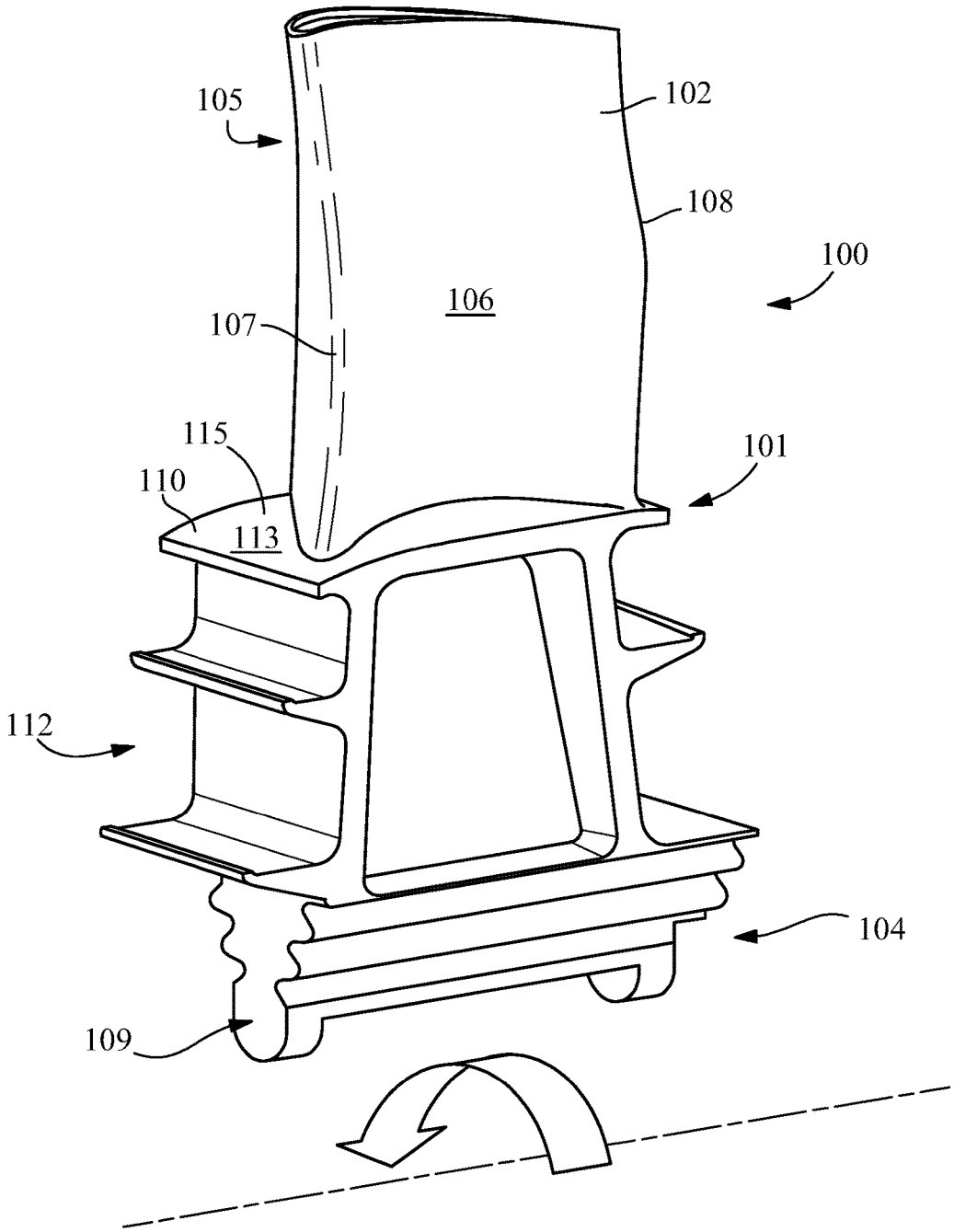
FIG. 1 illustrates a perspective view of an exemplary turbine rotor blade in which embodiments of the present disclosure may be employed.

Provided is a platform cooling arrangement 101 (FIG. 1) and method of creating a platform cooling arrangement for a turbine rotor blade 100. The platform cooling arrangement 101 and method of creating a platform cooling arrangement includes utilizing a platform slot 134 (FIG. 6) formed through at least one of the pressure side slashface 126 (FIG. 4) and the suction side slashface 122 (FIG. 4) of a platform at an interface between an airfoil 102 (FIG. 1) and a root 104 of the turbine rotor blade 100, the platform slot 134 (FIG. 7) being in fluid communication with the high-pressure coolant region 116 (FIG. 7) of the turbine rotor blade 100. An insert 130 (FIG. 7) is inserted in the platform slot 134, the insert having a blind channel 140 (FIG. 7) extending inside the insert from a predetermined location of the insert. The insert 130 aligns with the platform slot 134 to fluidly connect the channel 140 to the high-pressure coolant region 116 at the predetermined location to provide cooling for the turbine rotor blade at reduced cost.

Figure 2:
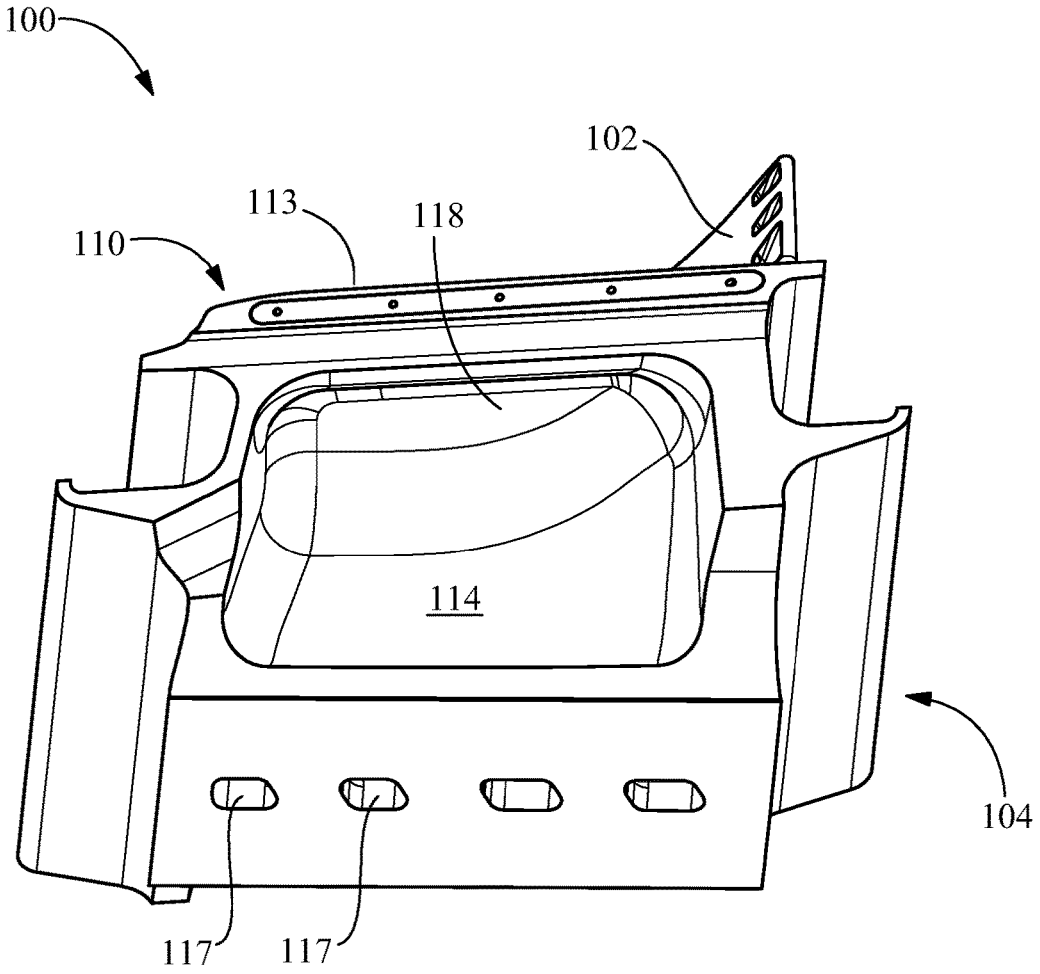
FIG. 2 illustrates an underside view of a turbine rotor blade in which embodiments of the present disclosure may be used.

Referring to FIGS. 1 and 2, turbine rotor blades 100 generally include an airfoil portion or airfoil 102 and a root portion or root 104. The airfoil 102 may be described as having a convex suction face 105 and a concave pressure face 106. The airfoil 102 further may be described as having a leading edge 107, which is the forward edge, and a trailing edge 108, which is the aft edge. The root 104 may be described as having structure (which, as shown, typically includes a dovetail 109) for affixing the blade 100 to the rotor shaft, a platform 110 from which the airfoil 102 extends, and a shank 112, which includes the structure between the dovetail 109 and the platform 110.

As illustrated, the platform 110 may be substantially planar. (Note that "planar," as used herein, means approximately or substantially in the shape of a plane. For example, one of ordinary skill in the art will appreciate that platforms may be configured to have an outboard surface that is slightly curved and convex, with the curvature corresponding to the circumference of the turbine at the radial location of the rotor blades. As used herein, this type of platform shape is deemed planar, as the radius of curvature is sufficiently great to give the platform a flat appearance.) More specifically, the platform 110 may have a planar topside 113, which, as shown in FIG. 1, may include an axially and circumferentially extending flat surface 115. As shown in FIG. 2, the platform 110 may have a planar underside 114, which may also include an axially and circumferentially extending flat surface 118. The topside 113 and the bottom side 114 of the platform 110 may be formed such that each is substantially parallel to the other. As depicted, it will be appreciated that the platform 110 typically has a thin radial profile, i.e., there is a relatively short radial distance between the topside 113 and the bottom side 114 of the platform 110.

In general, the platform 110 is employed on turbine rotor blades 100 to form the inner flow path boundary of the hot gas path section of the gas turbine. The platform 110 further provides structural support for the airfoil 102. In operation, the rotational velocity of the turbine induces mechanical loading that creates highly stressed regions along the platform 110 which, when coupled with high temperatures, ultimately cause the formation of operational defects, such as oxidation, creep, low-cycle fatigue cracking, and others. These defects, of course, negatively impact the useful life of the rotor blade 100. It will be appreciated that these harsh operating conditions, i.e., exposure to extreme temperatures of the hot gas path and mechanical loading associated with the rotating blades, create considerable challenges in designing durable, long-lasting rotor blade platforms 110 which both perform well and are cost-effective to manufacture.

One common solution to make the platform region 110 more durable is to cool it with a flow of compressed air or other coolant during operation, and a variety of these type of platform designs are known. However, as one of ordinary skill in the art will appreciate, the platform region 110 presents certain design challenges that make it difficult to cool in this manner. In significant part, this is due to the awkward geometry of this region, in that, as described, the platform 110 is a periphery component that resides away from the central core of the rotor blade and typically is designed to have a structurally sound, but thin radial thickness.

To circulate coolant, rotor blades 100 typically include one or more hollow cooling passages 116 (see FIGS. 3, 4 and 5) which, at minimum, extend radially through the core of the blade 100, including through the root 104 and the airfoil 102. As described in more detail below, to increase the exchange of heat, such cooling passages 116 may be formed having a serpentine path that winds through the central regions of the blade 100, though other configurations are possible. In operation, a coolant may enter the central cooling passages via one or more inlets 117 formed in the inboard portion of the root 104. The coolant may circulate through the blade 100 and exit through outlets (not shown) formed on the airfoil and/or via one or more outlets (not shown) formed in the root 104. The coolant may be pressurized, and, for example, may include pressurized air, pressurized air mixed with water, steam, and the like. In many cases, the coolant is compressed air that is diverted from the compressor of the engine, though other sources are possible. As discussed in more detail below, these cooling passages typically include a high-pressure coolant region and a low-pressure coolant region. The high-pressure coolant region typically corresponds to an upstream portion of the cooling passage that has a higher coolant pressure, whereas the low-pressure coolant region corresponds to a downstream portion having a relatively lower coolant pressure.

In some cases, the coolant may be directed from the cooling passages 116 into a cavity 119 formed between the shanks 112 and platforms 110 of adjacent rotor blades 100. From there, the coolant may be used to cool the platform region 110 of the blade, a conventional design of which is presented in FIG. 3. This type of design typically extracts air from one of the cooling passages 116 and uses the air to pressurize the cavity 119 formed between the shanks 112/platforms 110. Once pressurized, this cavity 119 then supplies coolant to cooling channels that extend through the platforms 110. After traversing the platform 110, the cooling air may exit the cavity through film cooling holes formed in the topside 113 of the platform 110.

It will be appreciated, however, that this type of conventional design has several disadvantages. First, the cooling circuit is not self-contained in one part, as the cooling circuit is only formed after two neighboring rotor blades 100 are assembled. This adds a great degree of difficulty and complexity to installation and pre-installation flow testing. A second disadvantage is that the integrity of the cavity 119 formed between adjacent rotor blades 100 is dependent on how well the perimeter of the cavity 119 is sealed. Inadequate sealing may result in inadequate platform cooling and/or wasted cooling air. A third disadvantage is the inherent risk that hot gas path gases may be ingested into the cavity 119 or the platform itself 110. This may occur if the cavity 119 is not maintained at a sufficiently high pressure during operation. If the pressure of the cavity 119 falls below the pressure within the hot gas path, hot gases will be ingested into the shank cavity 119 or the platform 110 itself, which typically damages these components as they were not designed to endure exposure to the hot gas-path conditions.

Figure 3:
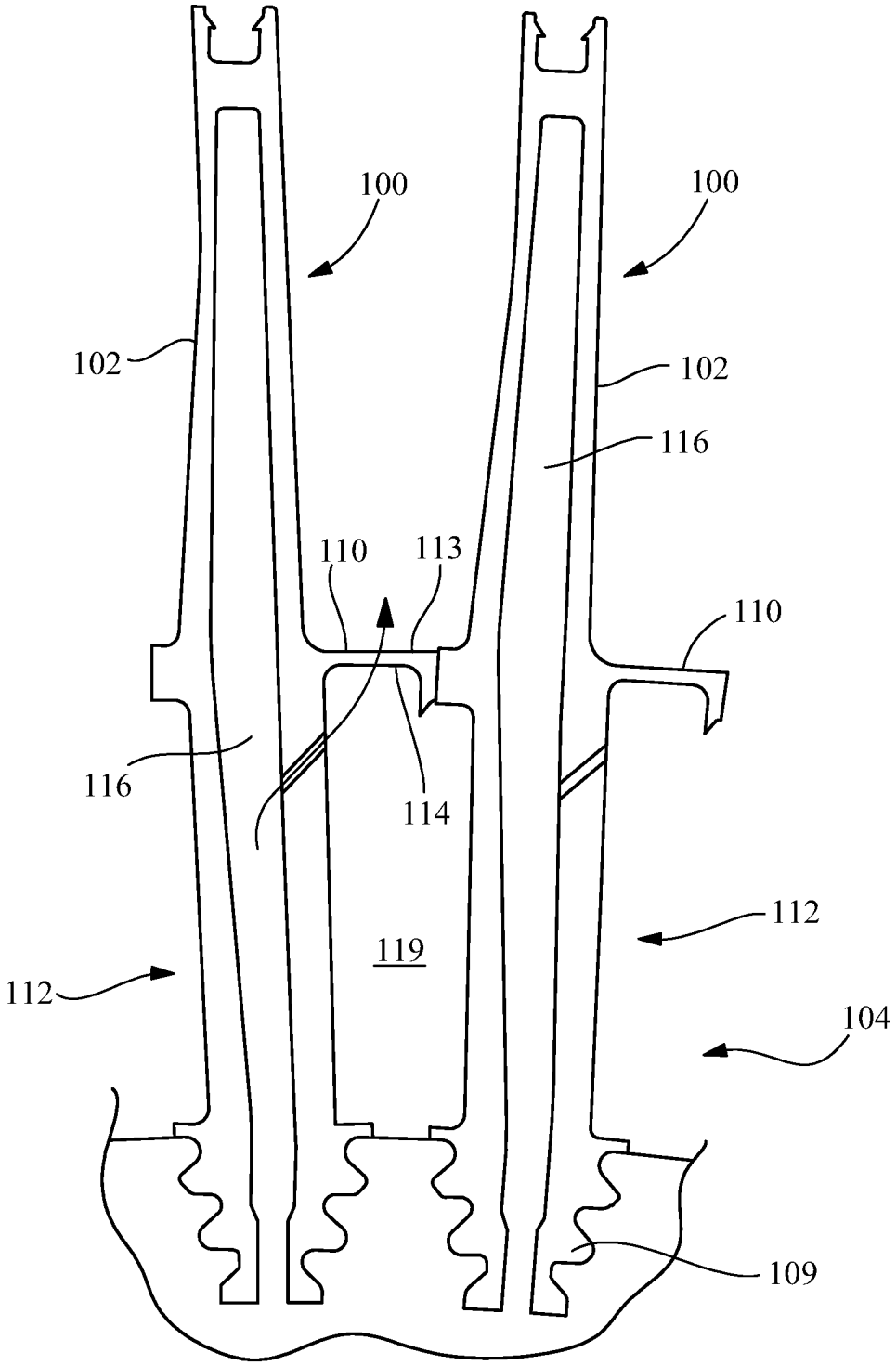
FIG. 3 (Prior Art)
FIG. 3 illustrates a sectional view of neighboring turbine rotor blades having a cooling system according to conventional design.
Figure 4:
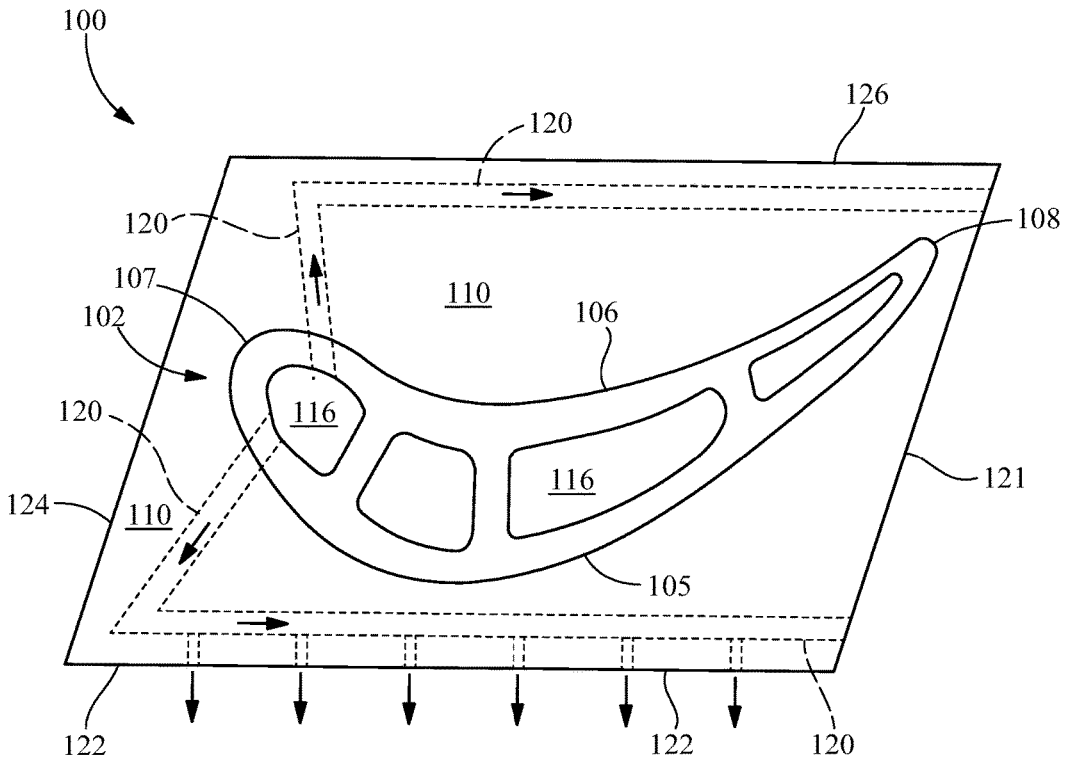
FIG. 4 (Prior Art)
FIG. 4 illustrates a cross-sectional view of a turbine rotor blade having a platform with interior cooling channels according to conventional design.
Figure 5:
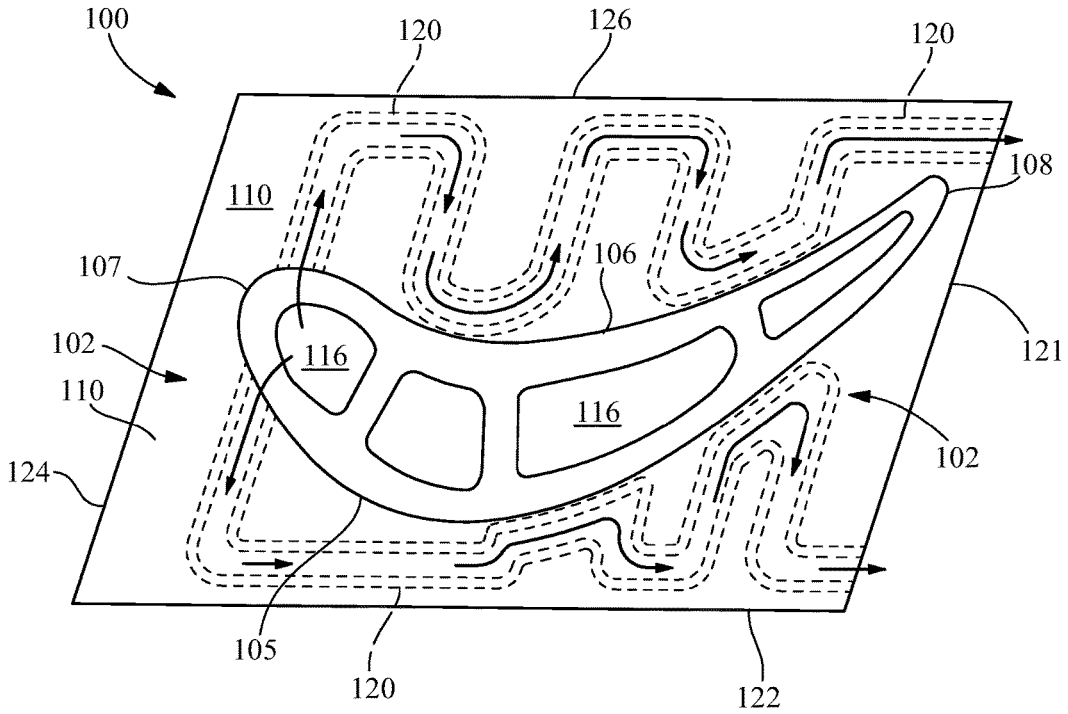
FIG. 5 (Prior Art)
FIG. 5 illustrates a top view of a turbine rotor blade having a platform with interior cooling channels according to an alternative conventional design.

FIGS. 4 and 5 illustrate another type of conventional design for platform cooling. In this case, the cooling circuit is contained within the rotor blade 100 and does not involve the shank cavity 119, as depicted. Cooling air is extracted from one of the cooling passages 116 that extend through the core of the blade 110 and directed aft through cooling channels 120 formed within the platform 110 (i.e., "platform cooling channels 120"). As shown by the several arrows, the cooling air flows through the platform cooling channels 120 and exits through outlets in the aft edge 121 of the platform 110 or from outlets disposed along the suction side edge 122. (Note that in describing or referring to the edges or faces of the rectangular platform 110, each may be delineated based upon its location in relation to the suction face 105 and pressure face 106 of the airfoil 102 and/or the forward and aft directions of the engine once the blade 100 is installed. As such, as one of ordinary skill in the art will appreciate, the platform may include an aft edge 121, a suction side edge 122, a forward edge 124, and a pressure side edge 126, as indicated in FIGS. 3 and 4. In addition, the suction side edge 122 and the pressure side edge 126 also are commonly referred to as "slashfaces" and the narrow cavity formed therebetween once neighboring rotor blades 100 are installed may be referred to as a "slashface cavity".)

It will be appreciated that the conventional designs of FIGS. 4 and 5 have an advantage over the design of FIG. 3 in that they are not affected by variations in assembly or installation conditions. However, conventional designs of this nature have several limitations or drawbacks. First, as illustrated, only a single circuit is provided on each side of the airfoil 102 and, thus, there is the disadvantage of having limited control of the amount of cooling air used at different locations in the platform 110. Second, conventional designs of this type have a coverage area that is generally limited. While the serpentine path of FIG. 5 is an improvement in terms of coverage over FIG. 4, there are still dead areas within the platform 110 that remain uncooled. Third, to obtain better coverage with intricately formed platform cooling channels 120, manufacturing costs increase dramatically, particularly if the cooling channels having shapes that require a casting process to form. Fourth, these conventional designs typically dump coolant into the hot gas path after usage and before the coolant is completely exhausted, which negatively affects the efficiency of the engine. Fifth, conventional designs of this nature generally have little flexibility. That is, the channels 120 are formed as an integral part of the platform 110 and provide little or no opportunity to change their function or configuration as operating conditions vary. In addition, these types of conventional designs are difficult to repair or refurbish.

It will be appreciated that turbine blades that are cooled via the internal circulation of a coolant typically include an interior cooling passage 116 that extends radially outward from the root, through the platform region, and into the airfoil, as described above in relation to several conventional cooling designs. It will be appreciated that certain embodiments of the present disclosure may be used in conjunction with conventional coolant passages to enhance or enable efficient active platform cooling, and the present disclosure is discussed in connection with a common design: an interior cooling passage 116 having a winding or serpentine configuration. The serpentine path is typically configured to allow a one-way flow of coolant and includes features that promote the exchange of heat between the coolant and the surrounding rotor blade 100. In operation, a pressurized coolant, which typically is compressed air bled from the compressor (though other types of coolant, such as steam, also may be used with embodiments of the present disclosure), is supplied to the interior cooling passage 116 through a connection formed through the root 104. The pressure drives the coolant through the interior cooling passage 116, and the coolant convects heat from the surrounding walls.

As the coolant moves through the cooling passage 116, it will be appreciated that it loses pressure, with the coolant in the upstream portions of the interior cooling passage 116 having a higher pressure than coolant in downstream portions. As discussed in more detail below, this pressure differential may be used to drive coolant across or through cooling passages formed in the platform. It will be appreciated that the present disclosure may be used in rotor blades 100 having internal cooling passages of different configurations and is not limited to interior cooling passages having a serpentine form. Accordingly, as used herein, the term "interior cooling passage" or "cooling passage" is meant to include any passage or hollow channel through which coolant may be circulated in the rotor blade. As provided herein, the interior cooling passage 116 of the present disclosure extends to at least to the approximate radial height of the platform 116, and may include at least one region of relatively higher coolant pressure (which, hereinafter, is referred to as a "region of high pressure" and, in some cases, may be an upstream section within a serpentine passage) and at least one region of relatively lower coolant pressure (which, hereinafter, is referred to as a "region of low pressure" and, relative to the region of high pressure, may be a downstream section within a serpentine passage).

In general, the various designs of conventional internal cooling passages 116 are effective at providing active cooling to certain regions within the rotor blade 100. However, as one of ordinary skill in the art will appreciate, the platform region proves more challenging. This is due, at least in part, to the platform's awkward geometry—i.e., its narrow radial height and the manner in which it juts away from the core or main body of the rotor blade 100. However, given its exposures to the extreme temperatures of hot gas path and high mechanical loading, the cooling requirements of the platform are considerable. As described above, conventional platform cooling designs are ineffective because they fail to address the particular challenges of the region, are inefficient with their usage of coolant, and/or are costly to fabricate.

Figure 6:
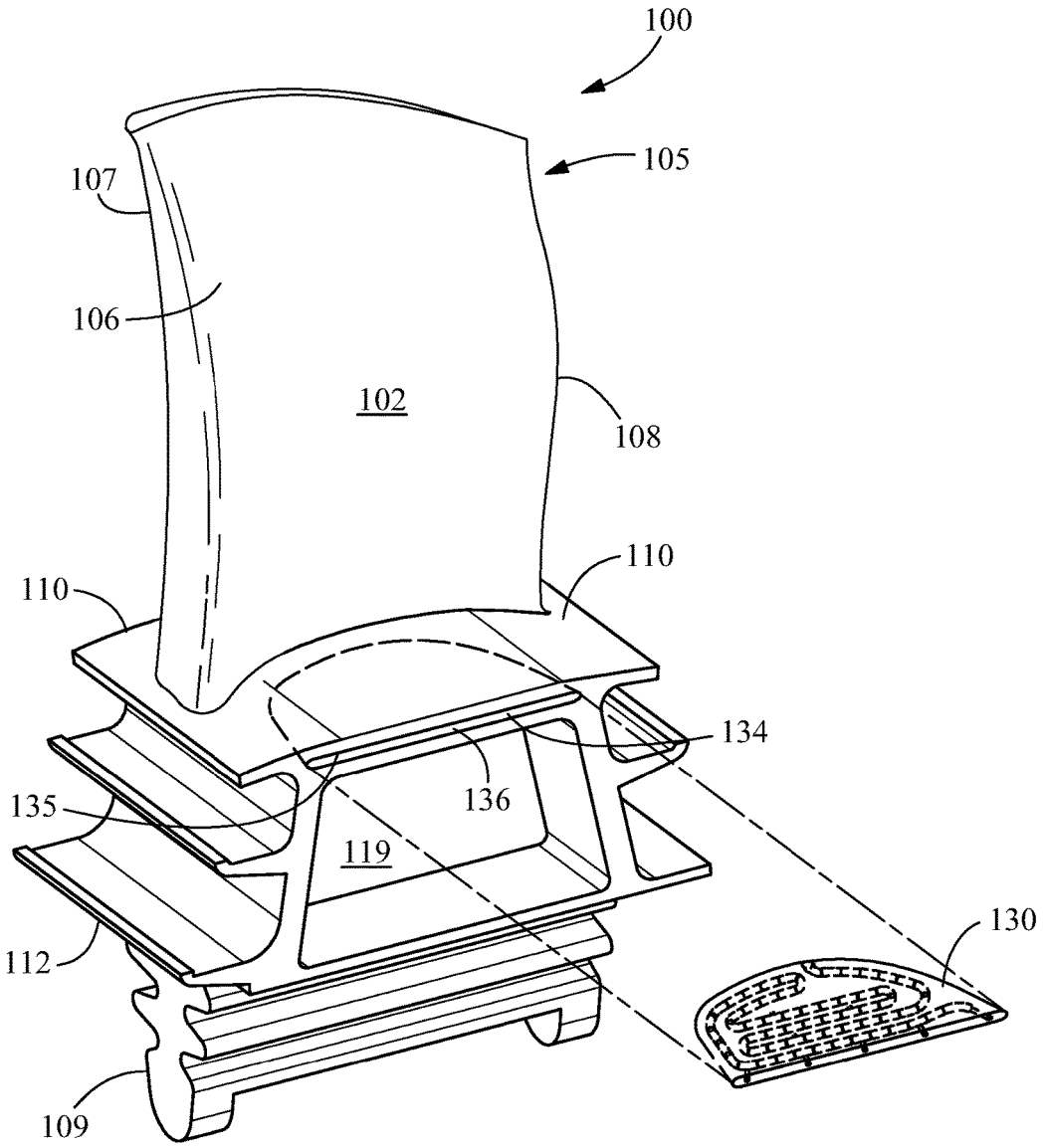
FIG. 6 illustrates a perspective view of a turbine rotor blade and platform insert in disassembled state according to an exemplary embodiment of the present disclosure.
Figure 7:
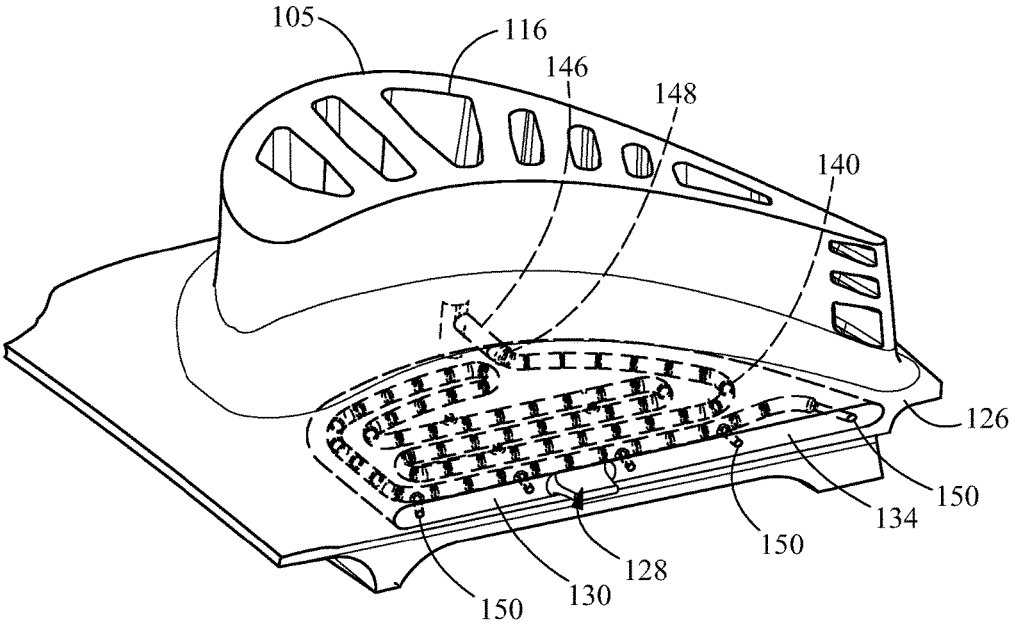
FIG. 7 illustrates a top perspective view of the platform with partial cross-sectional view of the turbine rotor blade and platform insert according to an exemplary embodiment of the present disclosure.

FIGS. 6 through 11 provide several views of exemplary embodiments of the present disclosure. Referring to FIG. 6, a perspective view of a turbine rotor blade 100 and an insert 130 according to an embodiment of the present disclosure is provided. As shown, the present disclosure generally includes an insert 130 that is installed within a turbine rotor blade 100. More specifically, the platform 110 of the rotor blade 100 may include a platform slot 134 that is formed so that the insert 130 fits therein. In one particularly suitable embodiment, as shown, the platform slot 134 may be positioned in the pressure side edge or slashface 126, though other locations along the other edges of the platform 110 are also possible, such as the suction side slashface 122. The platform slot 134 may have a generally rectangular shaped mouth, and may be described as including an outboard surface or ceiling 135 and an inboard surface or floor 136. As shown, the mouth may be configured such that it is relatively thin in the radial direction and relatively wide in the axial direction. It will be appreciated that, from the mouth, the platform slot 134 extends circumferentially into the platform 110, thereby forming a cavity therein.

The platform insert 130 may have a planar, thin, disk-like/plate shape and may be configured such that it fits within the platform slot 134 and, generally, has a similar profile (i.e., the vantage point of FIG. 7) as the platform slot 134.

The shape of the platform slot 134 may vary. In a particularly suitable embodiment, as more clearly shown in FIGS. 6 and 7, the platform slot 134 may extend circumferentially from the pressure side slashface or edge 126. It will be appreciated that the platform slot 134, in this particularly suitable embodiment, narrows as it extends from the pressure side slashface 126 toward the center of the platform 110. The narrowing may generally correspond to the curved profile that is formed at the junction of the airfoil pressure face 106 and the platform 110. As such, in profile (i.e., the shape from the vantage point of FIG. 7), the platform slot 134 may have a curved back or inner wall that relates closely to the curved profile of the airfoil pressure face 106. It should be apparent to those skilled in the art that other configurations of the platform slot 134 also may be employed. However, it will be appreciated that the embodiments of FIGS. 6 through 11 effectively address the cooling requirements for a large coverage area, which includes some of the more difficult areas within the platform 110 to cool. Those of ordinary skill in the art will appreciate that other performance advantages and efficiencies are possible.

Referring back to FIG. 7, once insert 130 is aligned, inserted and then secured, such as by brazing once the insert is fully inserted inside of platform slot 134, a passage 146 in fluid communication with cooling passage 116 of turbine rotor blade 100 is aligned with an opening 148 at a predetermined location 137 (FIG. 8) of insert 130 that is in fluid communication with a blind channel 140. In one embodiment, insert 130 is permanently secured in platform slot 134. In one embodiment, insert 130 is non-permanently secured in platform slot 134. As a result, during operation, coolant in cooling passage 116 is urged to flow via passage 146, through opening 148 at predetermined location 137 of insert 130 into channel 140 which has a lower pressure compared to cooling passage 116. As further shown in FIG. 7, insert 130 includes a surface 133 that is opposite opening 148 at predetermined location 137. In one embodiment, surface 133 is substantially flush or coincident with pressure side edge or slashface 126 such that coolant can flow from channel 140 through passages 150 toward a slashface of a platform 110 of an adjacent blade 100. In one embodiment, a tab or protrusion 128 extends outwardly from surface 133 to assist with inserting insert 130 inside of platform slot 134, with surface 133 being recessed relative to slashface 126. In one embodiment, a tab or protrusion 128 may also be functionally related to a corresponding slashface of the neighboring blade for securing insert 130 and position in platform slot 134. In one embodiment, tab or protrusion 128 may not be functionally related to a corresponding slashface of the neighboring blade.

Figure 8:
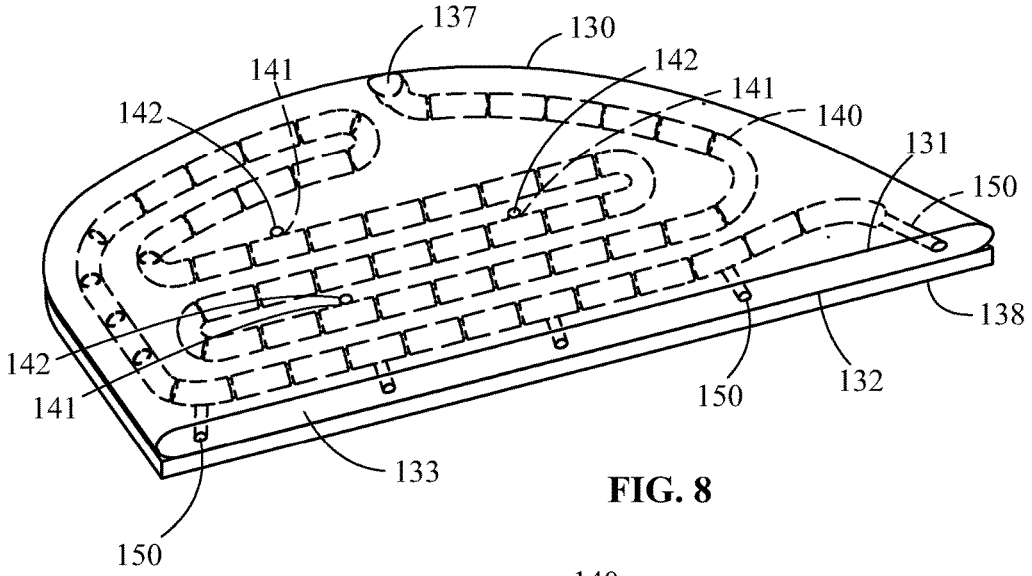
FIG. 8 illustrates a cross-sectional view of the platform insert according to an exemplary embodiment of the present disclosure.

FIG. 8 shows blind channel 140 formed inside of insert 130. The term "blind" means that only one end of the channel positioned inside of the insert extends to an opening formed in an exterior surface of the insert. For example, as shown, channel 140 extends to opening 148 at predetermined location of 137. In one embodiment, a plurality of channels (not shown) may be formed in the insert, with each channel extending to a different cooling passage 116 or to different portions of the same cooling passage 116. In one embodiment, each channel of the plurality of channels may operate separately of another channel, and none of the channels intersect. In one embodiment, at least a portion of one channel may intersect with another channel.

As further shown in FIG. 8, channel 140 includes at least one passage 141 that extends through surface 131 of insert 130, such as by a corresponding opening 142 formed through surface 131 which is opposite surface 132 facing a build plate 138 onto which the insert is formed or manufactured. During manufacturing of insert 130, such as by a suitable additive manufacturing process, passageway(s) 141 are formed in insert 130 to permit the removal of "loose" material, such as residual unfused powder from the additive manufacturing process, such as by introducing a pressurized fluid to predetermined location 137. Such residual material may otherwise obstruct flow through channel 140 and degrade cooling performance. A monitoring process, which may include an x-ray, may be used to determine if channel obstruction remains. Additive manufacturing processes include, but are not limited to, direct metal laser melting, direct metal laser sintering, selective laser sintering, direct metal laser sintering, laser engineered net shaping, selective laser sintering, selective laser melting, electron beam welding, used deposition modeling or a combination thereof.

FIG. 8 further shows passages 150 formed through surface 133 in fluid communication with channel 140, surface 133 being opposite predetermined location 137 of the channel, for providing cooling along slashface 126.

Figure 9:
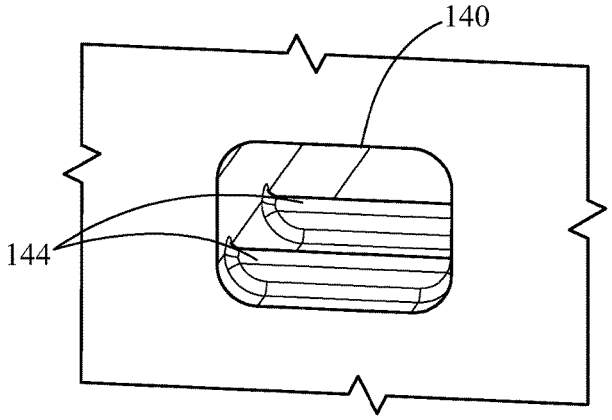
FIG. 9 illustrates a top perspective view of the channel of the platform insert according to an exemplary embodiment of the present disclosure.
Figure 10:
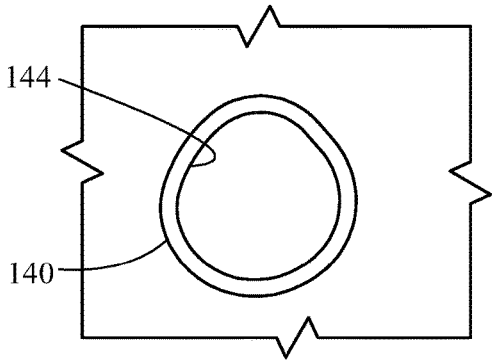
FIG. 10 illustrates a cross-sectional view of the channel of the platform insert according to an exemplary embodiment of the present disclosure.

FIGS. 9 and 10 show embodiments of cross-sections taken substantially perpendicular to the longitudinal direction in which the channel 140 (FIG. 8) extends. As shown in FIG. 9, channel 140 resembles a generally rectangular profile, while as shown in FIG. 10, the channel resembles a teardrop profile. It is to be appreciated that the channel may resemble other profiles. As further shown, channel 140 includes flow modification features 144 to enhance cooling performance, such as by altering flow characteristics, e.g., creating turbulent flow. As shown in FIG. 9, flow modification features 144 may be formed along a portion of a periphery of channel 140. Flow modification features 144 may protrude into the channel or may be recessed into the peripheral wall of the channel. As shown in FIG. 10, flow modification features 144 may be continuously formed along the entire periphery of at least a portion of channel 140. In one embodiment, at least a portion of flow modification features 144 may extend generally perpendicular to the longitudinal length of the channel 140. In one embodiment, at least a portion of flow modification features may extend anywhere between generally perpendicular to the longitudinal length of channel 140 and generally parallel to longitudinal length channel 140. It is to be appreciated that in one embodiment, the size, shape and profile of channels, including flow modification features may remain generally uniform, i.e. uniform cross-section, and that in other embodiments, one or more portions of the channel may have differences in at least one of size, shape, and profile of channels compared to other portions of the channel. In one embodiment, during manufacture of insert 130, at least a portion of channel 140 is constructed to resemble a teardrop profile, with profile changing during the manufacturing process, i.e., deformation of the profile of the channel to resemble a generally circular profile. It is to be understood that other profiles may be utilized that made to form into other predetermined channel profiles.

Figure 11:
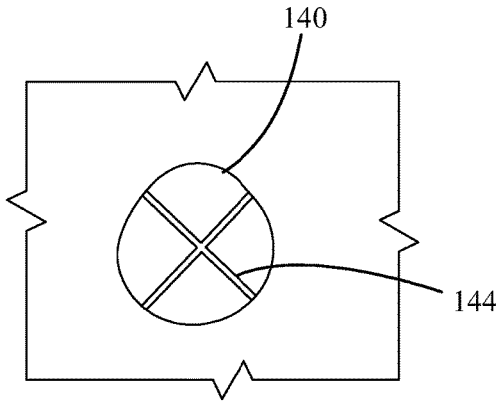
FIG. 11 illustrates a cross-sectional view of the channel of the platform insert according to an exemplary embodiment of the present disclosure.

FIG. 11 shows flow modification features 144 forming a lattice along at least a portion of the longitudinal length of channel 140 with the flow modification features intersecting each other. In one embodiment, the lattice may be formed via pre-determined additive manufacturing process algorithms. In one embodiment, the flow modification features 144 form a pattern, such as an X-shaped pattern. In one embodiment, the flow modification features 144 form a predetermined arrangement that is not a repeating pattern. In one embodiment, the flow modification features 144 do not intersect. In one embodiment, the flow modification features 144 are generally straight. In one embodiment, the flow modification features 144 are curved. In one embodiment, the flow modification features 144 comprise a single member extending between different points along the periphery of the channel. In one embodiment, the flow modification features 144 may vary in width. The arrangement of flow modification features depends upon the application and channel parameters, including shape, size, pressure drop, etc., for optimizing cooling of the turbine rotor blade 100.

Figure 12:
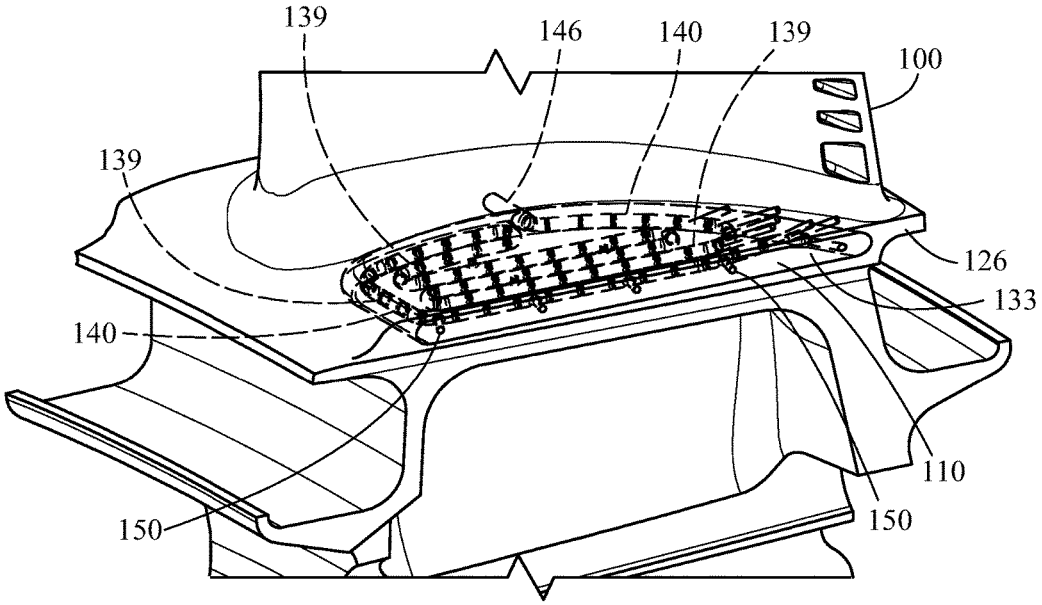
FIG. 12 illustrates an upper perspective partial cutaway view of the turbine rotor blade and platform insert according to an exemplary embodiment of the present disclosure.

FIG. 12 shows an exemplary arrangement of cooling passages 150 formed in insert 130 and cooling passages 139 extending through both insert 130 and platform 110 in fluid communication with channel 140. Cooling passages 139 are in direct fluid communication or fluid communication with an exterior region of blade 100 such as an exterior surface of airfoil 102 for providing enhanced cooling to the blade.

Figure 13:
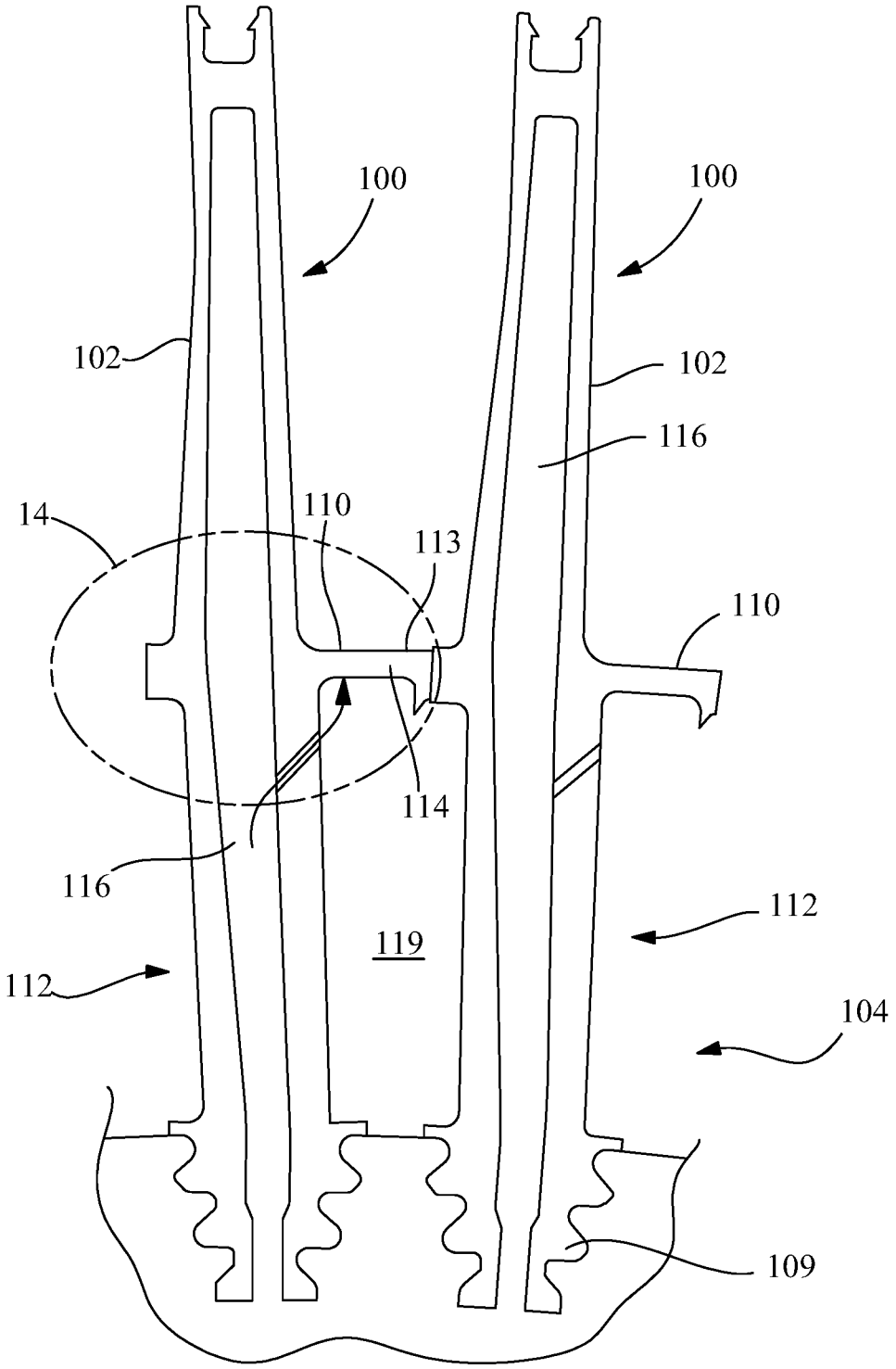
FIG. 13 illustrates a sectional view of neighboring turbine rotor blades having a cooling system according to an exemplary embodiment of the present disclosure.
Figure 14:
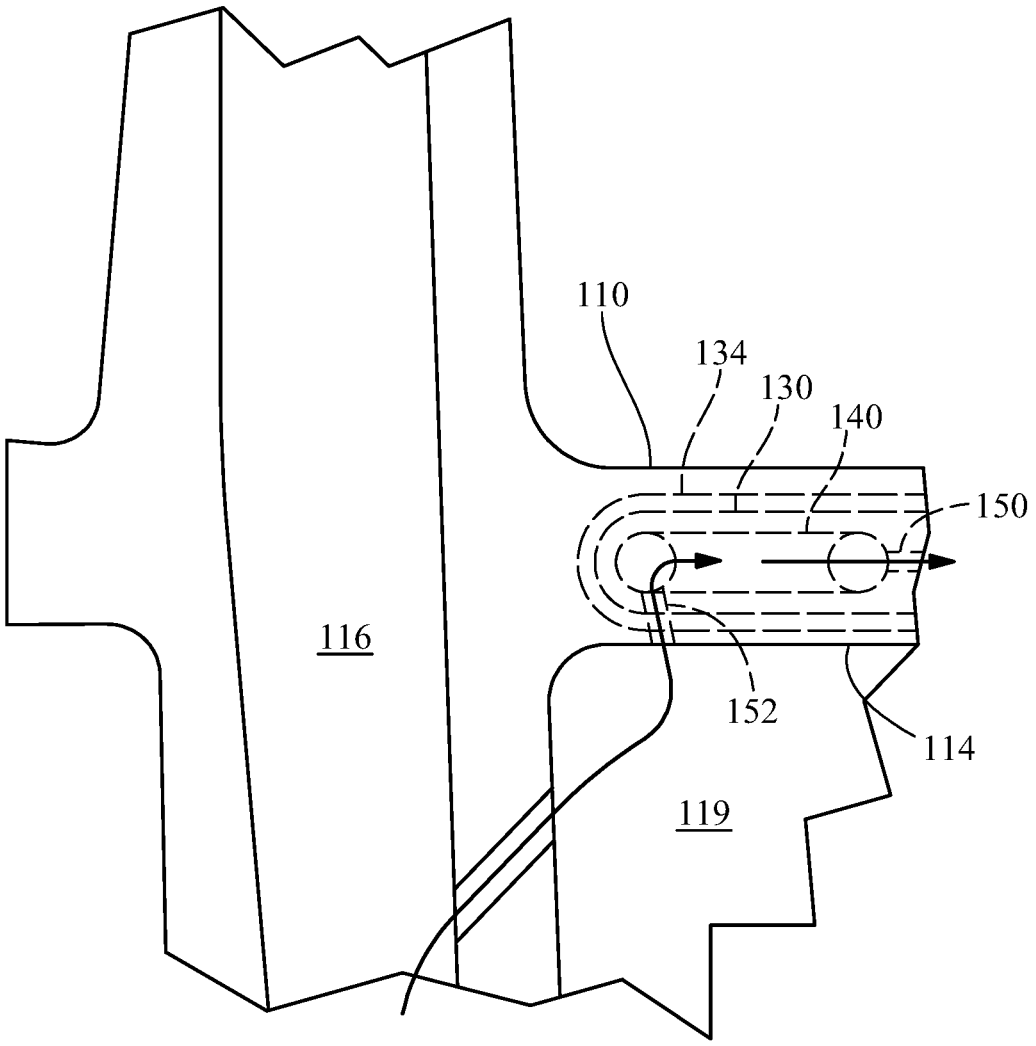
FIG. 14 illustrates a partial enlarged view of one neighboring turbine rotor blades taken from region 14 of FIG. 13 according to an exemplary embodiment of the present disclosure.

FIG. 13 and FIG. 14, which is an enlarged partial view taken along region 14 of FIG. 13, collectively show an exemplary flow path for providing cooling air to platform 110. Cooling air from cooling passage 116 flows through an aperture formed in blade 100 into cavity 119. By virtue of an aperture 152 formed through underside 114 of platform 110 and facing surface of insert 130, cooling air in cavity 119 is in fluid communication with and flows into channel 140, thereby providing cooling to the platform before exiting the insert via passages 150 as previously discussed. In one embodiment, aperture 152 is formed in platform 110 and insert 130 after the insert has been installed in platform slot 134. In one embodiment, corresponding portions of aperture 152 are formed in each of platform 110 and insert 130 prior to insertion of the insert in platform slot 134, with the corresponding portions of aperture 152 being aligned with each other.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A platform cooling arrangement in a turbine rotor blade having a platform at an interface between an airfoil and a root, wherein the rotor blade includes an interior cooling passage formed therein that extends from a connection with a coolant source at the root to at least the approximate radial height of the platform, wherein, in operation, the interior cooling passage comprises a high-pressure coolant region in fluid communication with a corresponding high-pressure coolant region of the platform, the high-pressure coolant region of the platform extending to a low-pressure coolant region of the platform at least one of a pressure side slashface and a suction side slashface, the platform cooling arrangement comprising:

a platform slot formed through at least one of the pressure side slashface and the suction side slashface, the platform slot being in fluid communication with the high-pressure coolant region of the turbine rotor blade;

an insert inserted in the platform slot, the insert having a blind channel extending inside the insert from a predetermined location of the insert, the insert aligns with the platform slot to fluidly connect the channel to the high-pressure coolant region at the predetermined location; and at least one passage in fluid communication with the channel and an exterior region of the turbine rotor blade.

2. The platform cooling arrangement of claim 1, wherein the insert having opposed generally flat surfaces, wherein at least one opening is formed through one of said generally flat surfaces in fluid communication with the channel.

3. The platform cooling arrangement of claim 1, wherein at least a portion of a periphery of at least a portion of the channel has a plurality of flow modification features.

4. The platform cooling arrangement of claim 3, wherein at least one flow modification feature of the plurality of flow modification features extends generally perpendicular to a cross-section of the channel.

5. The platform cooling arrangement of claim 1, wherein the channel has a generally uniform cross-section.

6. The platform cooling arrangement of claim 1, wherein at least a portion of the channel has a cross-section different from a cross-section of another portion of the channel.

7. The platform cooling arrangement of claim 1, wherein the insert has a surface opposite the predetermined location substantially aligning with one of the pressure side slashface and the suction side slashface when installed in the platform slot.

8. The platform cooling arrangement of claim 1, wherein the insert has a protrusion extending outwardly from a surface opposite the predetermined location.

9. The platform cooling arrangement of claim 3, wherein at least one portion of the plurality of flow modification features is a lattice.

10. A method of creating a platform cooling arrangement for a turbine rotor blade having a platform at an interface between an airfoil and a root, wherein the rotor blade includes an interior cooling passage formed therein that extends from a connection with a coolant source at the root to at least the approximate radial height of the platform, wherein, in operation, the interior cooling passage comprises a high-pressure coolant region in fluid communication with a corresponding high-pressure coolant region of the platform, the high-pressure coolant region of the platform extending to a low-pressure coolant region of the platform at least one of a pressure side slashface and a suction side slashface, the method comprising the steps of:

forming a platform slot through at least one of the pressure side slashface and the suction side slashface, the platform slot being in fluid communication with the high-pressure coolant region of the turbine rotor blade;

forming an insert that includes a blind channel extending inside of the insert from a predetermined location of the insert;

installing the insert within the platform slot such that the insert aligns with the platform slot to fluidly connect the channel to the high-pressure region at the predetermined location; and forming at least one passage in fluid communication with the channel and an exterior surface of the turbine rotor blade.

11. The method of claim 10, wherein forming an insert includes forming an insert by an additive manufacturing process.

12. The method of claim 11, wherein during forming an insert by an additive manufacturing process, the cross-section of the channel initially resembling a teardrop shape, wherein the teardrop shaped cross-section collapses to resemble a cross-section having a generally circular shape.

13. The method of claim 10, wherein forming an insert that includes a blind channel includes forming at least one opening in the channel.

14. The method of claim 10, wherein installing the insert within the platform slot further comprises aligning a surface of the insert opposite the predetermined location with one of the pressure side slashface and the suction side slashface when installed in the platform.

15. The method of claim 10, wherein forming an insert that includes a blind channel includes forming a plurality of flow modification features in the channel.

16. The method of claim 15, wherein at least one flow modification feature of the plurality of flow modification features extends generally perpendicular to a cross-section of the channel.

17. The method of claim 10, wherein forming an insert includes forming a protrusion extending outwardly from a surface opposite the predetermined location.

18. The method of claim 16, wherein at least one portion of the plurality of flow modification features formed is a lattice.

* * * * *